US011473335B1

(12) United States Patent
Wang et al.

(10) Patent No.: US 11,473,335 B1
(45) Date of Patent: Oct. 18, 2022

(54) ACOUSTIC-ELECTRIC REMOTE CONTROL RELEASE HOOK USED ON WATER AND UNDERWATER

(71) Applicants: FIRST INSTITUTE OF OCEANOGRAPHY, MINISTRY OF NATURAL RESOURCES, Qingdao (CN); QINGDAO NATIONAL LABORATORY FOR MARINE SCIENCE AND TECHNOLOGY DEVELOPMENT CENTER, Qingdao (CN)

(72) Inventors: Guanlin Wang, Qingdao (CN); Shujiang Li, Qingdao (CN); Guanhui Liang, Qingdao (CN); Fengjun Wang, Qingdao (CN)

(73) Assignees: FIRST INSTITUTE OF OCEANOGRAPHY, MINISTRY OF NATURAL RESOURCES, Qingdao (CN); QINGDAO NATIONAL LABORATORY FOR MARINE SCIENCE AND TECHNOLOGY DEVELOPMENT CENTER, Qingdao (CN)

( * ) Notice: Subject to any disclaimer, the term of this patent is extended or adjusted under 35 U.S.C. 154(b) by 0 days.

(21) Appl. No.: 17/570,031

(22) Filed: Jan. 6, 2022

(30) Foreign Application Priority Data

Jun. 21, 2021 (CN) ..... 202110682852.3

(51) Int. Cl.
*B66C 1/34* (2006.01)
*E05B 47/00* (2006.01)
(Continued)

(52) U.S. Cl.
CPC ..... *E05B 47/0001* (2013.01); *B66C 1/34* (2013.01); *H04R 1/44* (2013.01); *B63B 21/60* (2013.01)

(58) Field of Classification Search
CPC ..... B63B 21/58; B63B 21/60; B63B 27/16; B66C 1/34; E05B 47/0001; E05B 47/0012; H04R 1/44; F16B 45/021; F16B 45/023
(Continued)

(56) References Cited

U.S. PATENT DOCUMENTS 4,019,771 A * 4/1977 Perez ..... B63B 21/60 294/82.31
4,664,559 A * 5/1987 Berrang ..... B63B 21/60 114/294
(Continued)

FOREIGN PATENT DOCUMENTS

CN 102700683 A 10/2012
CN 105539737 B 1/2018

*Primary Examiner* — Dean J Kramer
(74) *Attorney, Agent, or Firm* — Oliff PLC

(57) ABSTRACT

An acoustic-electric remote control release hook used on water and underwater includes a first shell and a cylindrical framework. The cylindrical framework is fixedly connected with the first shell in a detachable mode; the first underwater transducer is remotely matched with a second water transducer which extends to the underwater through a cable, and the second water transducer is connected with a control switch through a cable. An acoustic command receiving module is arranged inside the first shell, and a power supply end of the acoustic command receiving module is connected with the power supply. A signal input end of the acoustic command receiving module is connected with the first underwater transducer through a cable and a watertight
(Continued)

connector assembly, and a signal output end of the acoustic command receiving module is connected with the driver of the direct-current motor.

5 Claims, 5 Drawing Sheets

(51) Int. Cl.
*H04R 1/44* (2006.01)
*B63B 21/60* (2006.01)

(58) Field of Classification Search
USPC ..... 294/82.3, 82.33
See application file for complete search history.

(56) References Cited

U.S. PATENT DOCUMENTS 5,513,886 A * 5/1996 Cyr ..... B63B 22/06
294/66.1
6,379,202 B1 * 4/2002 Liu ..... B66C 1/62
441/2

* cited by examiner

ACOUSTIC-ELECTRIC REMOTE CONTROL RELEASE HOOK USED ON WATER AND UNDERWATER

TECHNICAL FIELD

The present invention belongs to the technical field of marine observation, and specifically relates to release hook equipment that can be used on water and underwater at the same time and remotely operated by an electronic remote controller and an acoustic transducer.

BACKGROUND ART

Various instruments or equipment need to be used in a process of marine survey and observation. As the instruments or the equipment such as a gravity anchor are relatively heavy, generally 2 tons or more and even up to 3 tons, a winch is generally adopted for lifting and laying the instruments or the equipment out of a ship board to achieve fixed-point placing through a mechanical or electric releaser according to location and environment requirements.

An existing mechanical releaser includes a release hook and a mechanical locking device. The release hook that is commonly used in field at present is an artificial guy type or an electronic remote control type (the invention patent number: ZL20151 1026278.7), and the electronic remote control release hook improves the safety in a release process to a great extent.

The release hook only can achieve release operation on water and cannot normally work in seawater due to a relatively single function. In practical work, release operation is generally required underwater. For example, a winch must be used for dropping a seabed-shaped observation system to a seabed to release so as to ensure a correct pose in a laying process. An acoustic releaser is generally adopted to release at present, and the acoustic releaser and a releaser deck unit need to be independently arranged, such that the operation cost is greatly reduced. Meanwhile, danger is liable to occur in practical operation in terrible ocean environment as the releaser is too great and heavy.

SUMMARY

The present invention provides an acoustic-electric remote control release hook used on water and underwater for solving defects in the prior art. While keeping all functions of an existing release hook that only can operate on water, the release hook in the present invention is additionally provided with an acoustic transducer that can be assembled and combined. While used for water operation, the release hook is the same as a traditional electronic remote control release hook in structure, and when underwater release operation needs to be carried out, the underwater acoustic remote control release hook which can be rapidly opened underwater through acoustic command can be formed only by additionally assembling and combining the transducer part and matching with the water transducer, so the underwater acoustic remote control release hook has multiple purposes in the true sense, the operation cost is greatly reduced, and the operation safety is improved.

To achieve the objective, the present invention adopts the following technical solution:

An acoustic-electric remote control release hook used on water and underwater includes a first shell and a cylindrical framework. A release hook assembly in which a direct-current motor, a controller, a receiver and a power supply are mounted is mounted on the lower portion of the first shell; the power supply is respectively connected with a power supply end of the direct-current motor and a power supply end of the controller, a signal input end of the controller is connected with the receiver, a signal output end of the controller is connected with a driver of the direct-current motor, and a motor shaft of the direct-current motor downwards extends to the outside of the first shell; the release hook assembly includes side plates, a hook body and a movable block, the upper portions of the side plates are fixed with the first shell, one side of the upper portion is hinged with the movable block, and the lower portions of the side plates are hinged with one end of the hook body; the end part, close to a hinged point with the side plates, of the movable block is equipped with a clamping structure matched with the free end of the hook body, and a release actuating mechanism is arranged between the other end of the movable block and the motor shaft; the release actuating mechanism can control the movable block to be separated from the free end of the hook body; the cylindrical framework is fixedly connected with the first shell in a detachable mode; an underwater transducer is fixedly arranged inside the cylindrical framework in the detachable mode; the underwater transducer is remotely matched with a water transducer, and the water transducer is connected with a control switch through a cable; an acoustic command receiving module is arranged inside the first shell, and a power supply end of the acoustic command receiving module is connected with the power supply; and a signal input end of the acoustic command receiving module is connected with the underwater transducer through a cable and a watertight connector assembly, and a signal output end of the acoustic command receiving module is connected with the driver of the direct-current motor.

The end part of the movable block is fixedly equipped with a connecting rod which is matched with the release actuating mechanism.

The release actuating mechanism includes a fixator mounted at the lower end of the motor shaft; the fixator includes clamping teeth which are symmetrically arranged, and arc-shaped through slots are formed in the upper portions of the clamping teeth; the arc-shaped through slots in the two clamping teeth are opposite and define a channel for accommodating the connecting rod; and when the motor shaft actuates, the connecting rod can be dropped from the clamping teeth or the connecting rod is fixed with the clamping teeth.

The two side plates are arranged in parallel, and a cavity is formed between the two side plates; and the hinged end of the movable block and the hook body is arranged in the cavity.

The bottom end of the release actuating mechanism is fixedly equipped with a nut block which can synchronously rotate along with the release actuating mechanism; the nut block is screwed with one end of a lead screw shaft, the other end of the lead screw shaft is fixedly equipped with one end of a first rack, and the first rack is fixedly equipped with a second rack.

The side portion of an adapting shaft between the side plates and the hook body is fixedly equipped with a shaft gear which is engaged with the second rack, and the shaft gear can drive the hook body to rotate; the side walls of the side plates are further equipped with a third rack in a sliding mode, and a synchronous gear is arranged and meshed between the third rack and the first rack; and when the first rack moves downwards, the third rack moves upwards under action of meshed transmission.

One side of the movable block is further fixedly equipped with a starting plate, and the top end of the third rack is fixedly equipped with a jacking structure which can jack the starting plate.

To further achieve the objective, the present invention further adopts the following technical solution:

Further, a groove is formed in the movable block below the fixator, and the fixator downwards extends into the groove; and a transverse connecting rod, two ends of which are fixed with the movable block, is arranged in the groove.

Further, a hoisting ring is mounted above the cylindrical framework.

Further, the other end of the first rack is fixedly equipped with a transmission connecting rod which is fixedly equipped with the second rack.

The second rack can synchronously move along with up-down reciprocating motion of the transmission connecting rod, the first rack and the lead screw shaft in sequence.

Further, the jacking structure is a delay telescopic rod.

The top end of the third rack is fixed with one end of the delay telescopic rod, and the other end of the delay telescopic rod is fixed with the starting plate.

Further, the direct-current motor is a direct-current reduction motor driven by 12V, 24V or 36V voltage.

The present invention has the following beneficial effects:

Firstly, the movable block and the hook body can be respectively opened on water and underwater by combining a remote control mode with acoustic command; and in use, opening action of the hook body and the movable block can be accomplished by pressing a button on a remote controller. Compared with an existing guy type releaser used in the marine survey field, the acoustic-electric remote control release hook used on water and underwater in the present direction is accurate in release action and time, is free of external disturbance, and can effectively guarantee safety operation requirements of an operator and hoisting equipment. While used for water operation, the release hook is the same as a traditional electronic remote control release hook in structure; and when underwater release operation needs to be carried out, the underwater acoustic remote control release hook which can be rapidly opened underwater through acoustic command can be formed only by additionally assembling and combining the transducer part and matching with the water transducer, so the underwater acoustic remote control release hook has multiple purposes in the true sense, the operation cost is greatly reduced, and the operation safety is improved.

Secondly, the control system in the present invention consists of a direct-current motor, a controller, a receiver, a power supply and a remote controller, where the direct-current motor adopts a 12V or 24V direct-current reduction motor; and the controller adopts an integrated control module matched with the direct-current reduction motor, and is convenient to assemble and use, so that equipment cost can be greatly reduced, and a greater popularization and application value is achieved; and all parts of the control system are mounted in the sealed waterproof first shell, so that the service life, under a wild humid environment, of the control system is prolonged.

Thirdly, the release actuating mechanism has various structures and forms, weight of borne matters to be released can be greatly increased through the lever principle, and the motor shaft can stably drive the movable block to act, so that the hook body is guaranteed to be free of errors; and meanwhile, the release actuating mechanism is free of a wear surface, so that wear when the movable block works is reduced, and better safety performance is achieved. The release actuating mechanism which is realized by the connecting rod and the fixator can completely achieve closing or opening of the movable block and the hook body by virtue of positive rotation or negative rotation of the direct-current motor, and is especially suitable for being used under relatively bumpy environmental conditions such as a marine survey ship.

Fourthly, a rotating mechanism is arranged between the hoisting ring and the first shell; the rotating mechanism includes a second shell consisting of a transverse plate, an outer shell and a circular ring end cover; a connecting shaft is mounted in the second shell; a radial arc-shaped groove is formed in the middle of the connecting shaft; an elastic part is mounted in the arc-shaped groove; and a brake block is mounted at the outer end of the elastic part. Under a normal condition that the instruments or equipment shake or rotate slightly, the brake block is withdrawn in the arc-shaped groove under the action of the elastic part, and the connecting shaft can drive the first shell to normally rotate positively and negatively; when the instruments or equipment shake or rotate greatly, the brake block can pop up outwards to be in contact with the inner wall of the outer shell under action of centrifugal force when the connecting shaft rotates, so that friction force between the connecting shaft and the outer shell is increased to prevent action from being transmitted to a steel cable and keep a state that the matters to be released are gradually restored to be stable. To further improve the matching effect between the brake block and the outer shell, a brake slot corresponding to the brake block is further formed in the inner wall of the outer shell or an inner cavity is arranged on the brake block; and the inner cavity is filled with liquid to increase centrifugal force on the brake block when the connecting shaft rotates.

Figure 1:
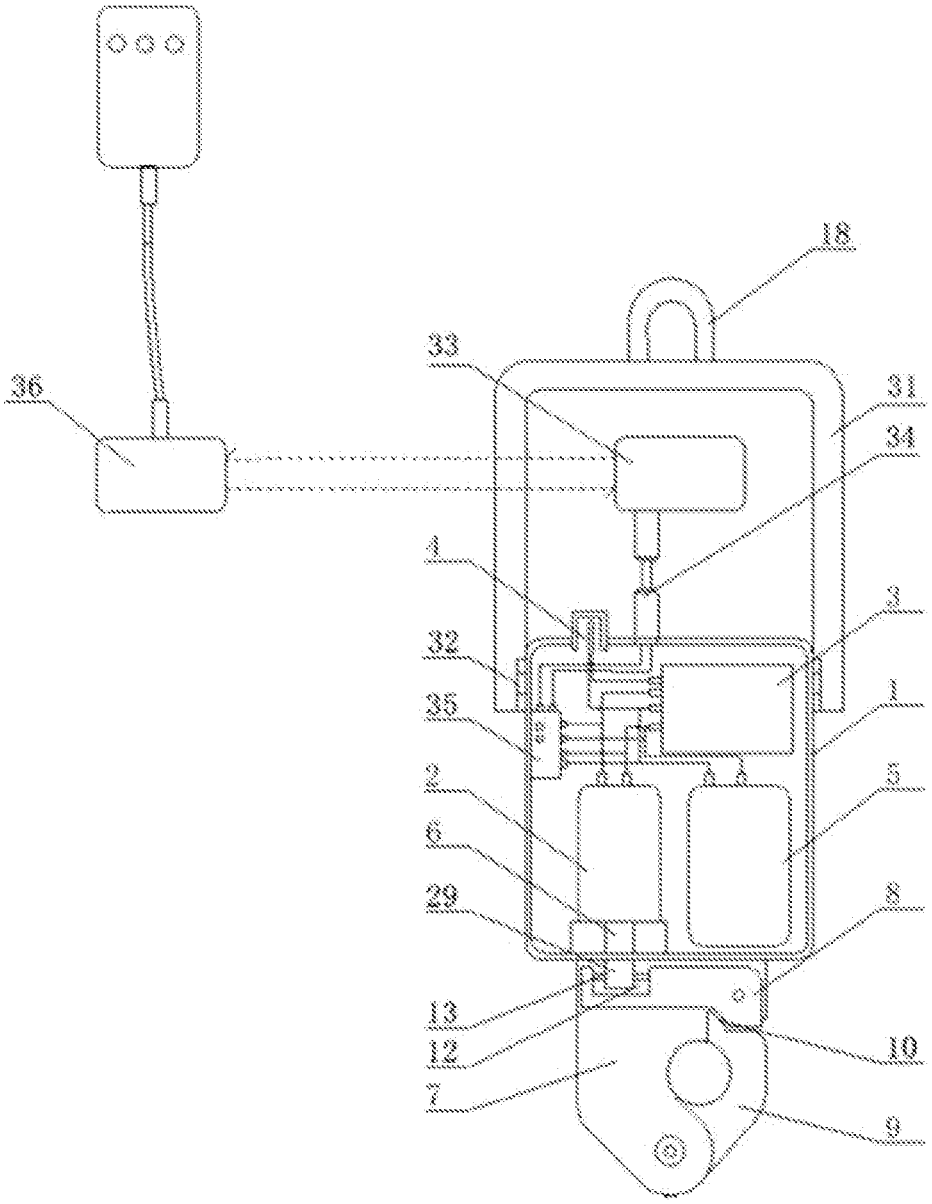
FIG. 1 is a structural diagram of a first embodiment of the present invention.
Figure 2:
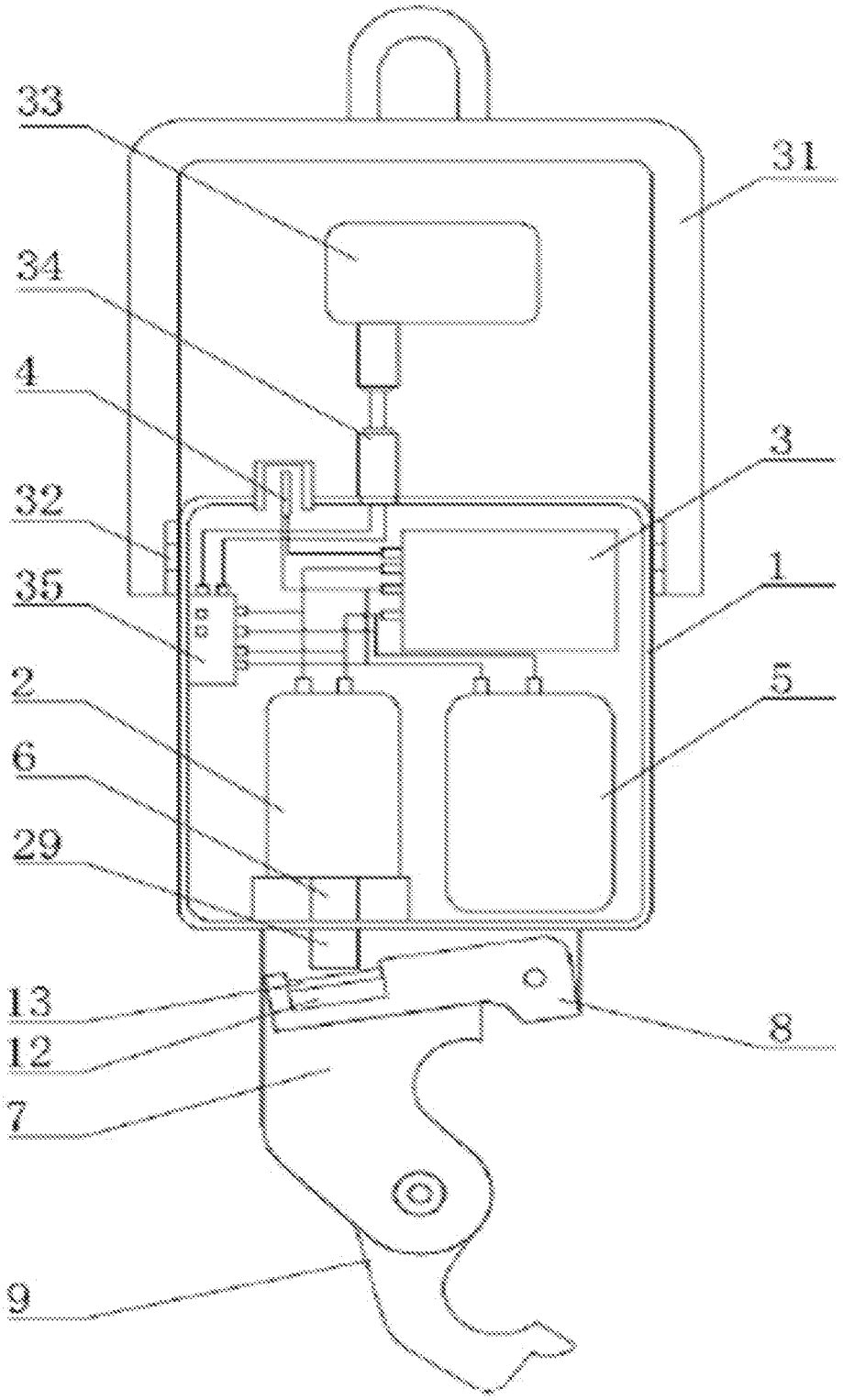
FIG. 2 is a reference diagram showing another state of FIG. 1 (namely a structural diagram when the hook body is opened).

Reference numerals: 1, first shell; 2, direct-current motor; 3, controller; 4, receiver; 5, power supply; 6, motor shaft; 7, side plate; 8, movable block; 9, hook body; 10, clamping structure; 11, fixator; 12, groove; 13, connecting rod; 14, channel; 16, clamping tooth; 17, arc-shaped through slot; 18, hoisting ring; 19, cavity; 29, release actuating mechanism; 31, cylindrical framework; 32, connecting buckle; 33, underwater transducer; 34, watertight connector assembly; 35, acoustic command receiving control module; 36, water transducer; 37, nut block; 38, lead screw shaft; 39, first rack; 40, transmission connecting rod; 41, second rack; 42, shaft gear; 43, synchronous gear; 44, third rack; 45, delay telescopic rod; and 46, starting plate.

DETAILED DESCRIPTION OF THE EMBODIMENTS

In order to make the objectives, technical solutions, and advantages of the embodiments of the present invention clearer, the technical solutions in the embodiments of the present invention will be described clearly and completely in combination with the drawings in the embodiments of the present invention. Obviously, the described embodiments are part of, but not all of, the embodiments of the present invention.

Embodiment 1

As shown in FIG. 1 to FIG. 6, the present invention provides an acoustic-electric remote control release hook used on water and underwater, including a first shell 1 and a cylindrical framework 31. A release hook assembly in which a direct-current motor 2, a controller 3, a receiver 4 and a power supply 5 are mounted is mounted on the lower portion of the first shell 1; the power supply 5 is respectively connected with a power supply end of the direct-current motor 2 and a power supply end of the controller 3 for providing a working power supply; a signal input end of the controller 3 is connected with the receiver 4, a signal output end of the controller 3 is connected with a driver of the direct-current motor 2, and a motor shaft 6 of the direct-current motor 2 downwards extends to the outside of the first shell 1; the release hook assembly includes side plates 7, a hook body 9 and a movable block 8, the upper portions of the side plates 7 are fixed with the first shell 1, one side of the upper portion is hinged with the movable block 8, and the lower portions of the side plates 7 are hinged with one end of the hook body 9; the end part, close to a hinged point with the side plates 7, of the movable block 8 is equipped with a clamping structure 10 matched with the free end of the hook body 9, and a release actuating mechanism 29 is arranged between the other end of the movable block 8 and the motor shaft 6; the release actuating mechanism 29 can control the movable block 8 to be separated from the free end of the hook body 9, and the movable block 8 and the hook body 9 define a lever actuating structure through the release actuating mechanism 29; the cylindrical framework 31 is fixedly connected with the first shell 1 in a detachable mode; an underwater transducer 33 is fixedly arranged inside the cylindrical framework 31 in the detachable mode; the underwater transducer 33 is remotely matched with a water transducer 36, and the water transducer 36 is connected with a control switch through a cable; an acoustic command receiving module 35 is arranged inside the first shell 1, and a power supply end of the acoustic command receiving module 35 is connected with the power supply 5 for providing a working power supply of the acoustic command receiving module 35; and a signal input end of the acoustic command receiving module 35 is connected with the underwater transducer 33 through a cable and a watertight connector assembly 34, and a signal output end of the acoustic command receiving module 35 is connected with the driver of the direct-current motor 2, so that underwater hook opening action is achieved through acoustic transmission; and the watertight connector assembly 34 can achieve signal transmission and also has a power supply function.

Specifically, remote operation can be achieved through a remote control mode during working on water; and the release actuating mechanism 29 controls the movable block 8 and the hook body 9 to open, and the movable block 8 forms the lever actuating structure on the hook body 9, so that weight of bearable matters to be released can be greatly increased. Opening action of the hook body 9 and the movable block 8 can be accomplished by only needing to remotely press the button on the remote controller, the release action and time is accurate, external interference can be avoided, and safety operation requirements of the operator and the hoisting equipment can be effectively guaranteed. When the releaser is used, the hoisting ring 18 is firstly connected with the hoisting winch, and the remote controller starts the direct-current motor 2 to open the release actuating mechanism 29 through the controller 3, so that the release actuating mechanism 29 is locked through the remote controller after instruments or equipment to be released are fixedly connected to the hook body. After the hoisting winch is hoisted to a specified release position, the remote controller is remotely pressed to start the direct-current motor 2 to drive the release actuating mechanism 29 to accomplish release of the instruments or the equipment. The releaser is withdrawn through the hoisting winch after the work is ended, the parts of the releaser are cleaned, and a polymer battery for the power supply 5 is charged, and the like.

To guarantee use under environments such as a marine humid environment and a corrosion environment, the first shell 1 adopts a sealed waterproof structure, and a sealing ring is mounted between the motor shaft 6 and the first shell 1. At the same time, the receiver is mounted on the side surface of the first shell and is protruded to the side wall of the first shell to receive a remote control signal. To guarantee water tightness underwater, the first shell 1 is set to be a cylindrical shell which can be stably sealed with the cylindrical framework 31.

While underwater hook opening action is accomplished by acoustic command during underwater working, a signal transmission end of the watertight connector assembly 34 only needs to connect to the underwater transducer 33; the cylindrical framework 31 is assembled and combined with the first shell 1 through a connecting buckle 32 of the cylindrical framework 31, and is matched with the water transducer 36 that extends to underwater through a cable as the underwater acoustic remote control release hook which can be rapidly opened underwater through acoustic command, so the underwater acoustic remote control release hook has multiple purposes in the true sense, the operation cost is greatly reduced, and the operation safety is improved.

Before the acoustic remote control release hook is used, the hoisting ring 18 of the cylindrical framework 31 is firstly connected with the hoisting winch, and the release hook is opened by the remote controller and then locked after the instruments or the equipment to be released is stably connected to the release hook. When the first shell 1, the cylindrical framework 31 and an accompanying structure thereof are dropped to a specified underwater depth or the seabed, the water transducer 36 is put under water; the acoustic command is sent by the control switch at the tail end of a cable of the under traducer 36 which has been placed into water, and an acoustic command signal is received by the underwater transducer 33 and is further transmitted to the acoustic command receiving module 35 mounted in the first shell 1 through the cable; and after the acoustic command receiving control module 35 receives the acoustic command, the direct-current motor 2 inside the first shell 1 is started; and the direct-current motor 2 drives the release actuating mechanism 29 to rotate until the release hook loosens and releases the equipment. The release hook is withdrawn through the winch after the work is ended, and operations of cleaning the release hook assembly, charging the polymer lithium battery and the like are carried out according to needs. When the releaser is in power shortage, a special cable can be connected with the watertight connector assembly 34 of the underwater transducer 33 for charging.

More specifically, continuously refer to FIG. 1 to FIG. 6, the release actuating mechanism 29 in the embodiment includes a fixator 11 arranged at the lower end of the motor shaft 6, a groove 12 is formed in the end part of the movable block 8, and the fixator 11 extends into the groove 12; a transverse connecting rod 13, the two ends of which are fixed with the movable block, is arranged in the groove 12; the fixator 11 includes clamping teeth 16 which are symmetrically arranged, and arc-shaped through slots 17 are formed in the upper portions of the clamping teeth 16; the arc-shaped through slots 17 in the two clamping teeth 16 are opposite and define a channel 14 for accommodating the connecting rod; and when the motor shaft 6 actuates, the connecting rod 13 can be dropped from the clamping teeth 16 or the connecting rod 13 is fixed with the clamping teeth 16.

The direct-current motor 2 in the embodiment adopts a 12V-voltage direct-current reduction motor, and the power supply 5 is a matched 12V-voltage polymer chargeable battery.

Figure 3:
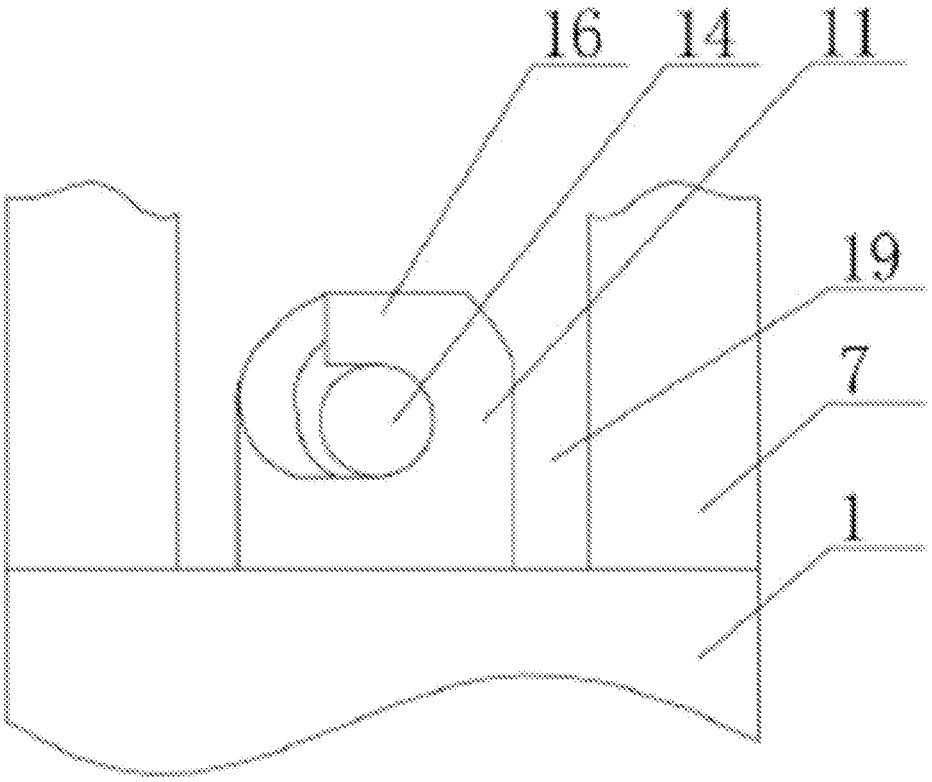
FIG. 3 is a schematic diagram of an enlarged structure of the fixator in FIG. 1.
Figure 4:
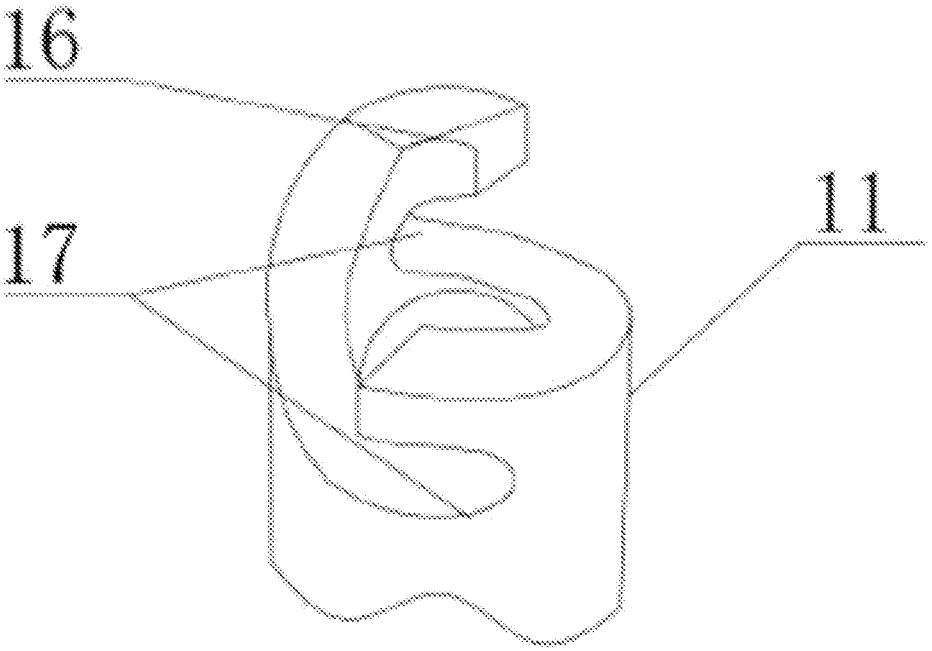
FIG. 4 is a perspective view of the fixator in FIG. 1.
Figure 5:
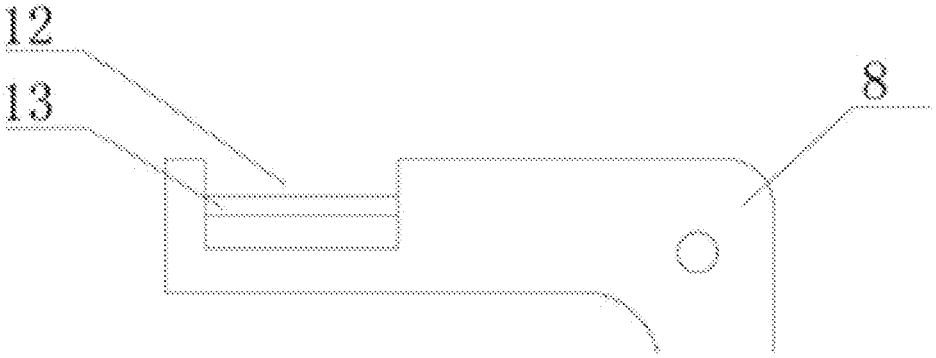
FIG. 5 is a schematic diagram of an enlarged structure of the movable block in FIG. 1.
Figure 6:
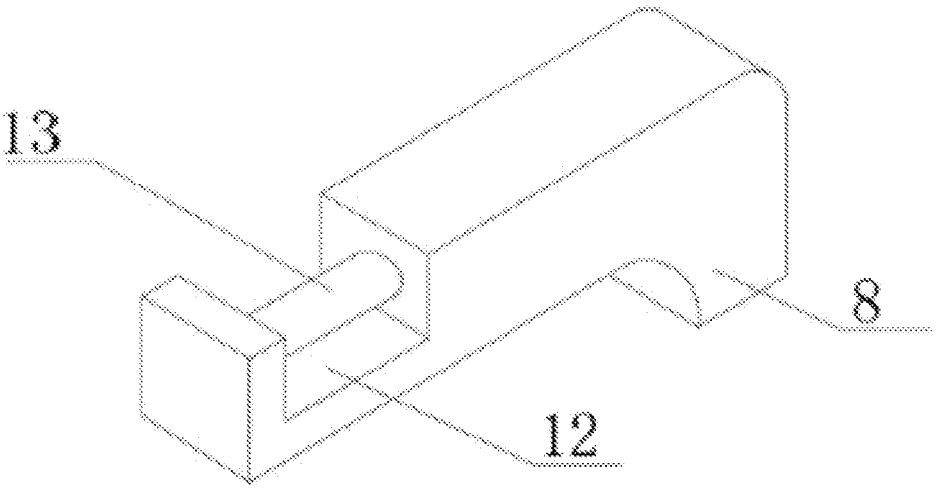
FIG. 6 is a perspective view of FIG. 5.

Further, as shown in FIG. 3, two side plates 7 in the embodiment are arranged in parallel, a cavity 19 is formed between the two side plates 7; and the movable block 8 and the hook body are arranged in the cavity 19. The two side plates 7 are arranged, so that the movable block 8 and the hook body are respectively hinged with the side plates 7, and thus, the stability when two parts rotate and actuate is improved.

Embodiment 2

Figure 7:
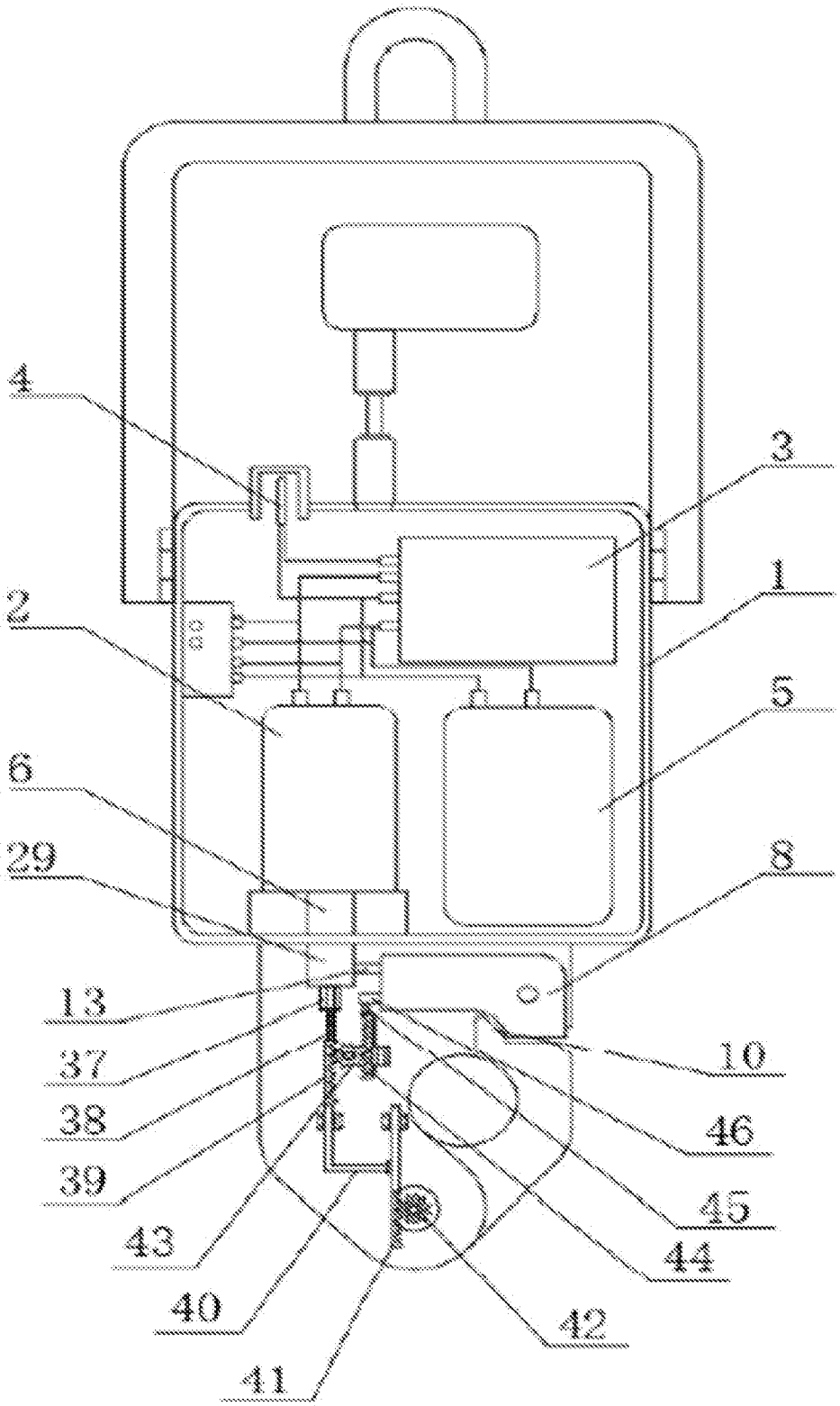
FIG. 7 is a structural diagram of a second embodiment of the present invention.

In the embodiment 2, same symbols are given for the same structure in embodiment 1, so that a same description is omitted. The embodiment 2 is improved on the basis of embodiment 1. As shown in FIG. 7, the connecting rod 13 is directly and fixedly arranged on the end part of the movable block 8, and the connecting rod 13 is matched with the release actuating mechanism 29; the bottom end of the release actuating mechanism 29 is fixedly equipped with a nut block 37 which can synchronously rotate along with the release actuating mechanism 29; the nut block 37 is screwed with one end of a lead screw shaft 38, and the other end of the lead screw shaft 38 is fixedly equipped with one end of a first rack 39, and the other end of the first rack 39 is fixedly equipped with a transmission connecting rod 40; the transmission connecting rod 40 is fixedly equipped with a second rack 41 which can synchronously move along with up-down reciprocating motion of the transmission connecting rod 40, the first rack 39 and the lead screw shaft 38 in sequence; the side portion of an adapting shaft between the side plates 7 and the hook body 9 is fixedly equipped with a shaft gear 42 which is engaged with the second rack 41, and the shaft gear 42 can drive the hook body 9 to rotate; the side walls of the side plates 7 are further equipped with a third rack 44 in a sliding mode, and a synchronous gear 43 is arranged and meshed between the third rack 44 and the first rack 39; and when the first rack 39 moves downwards, the third rack 44 moves upwards under action of meshed transmission. One side of the movable block 8 is further fixedly equipped with a starting plate 46, and the top end of the third rack 44 is fixed with one end of a delay telescopic rod 45, and the other end of the delay telescopic rod 45 abuts against the starting plate 46 for delaying time of jacking the starting plate 46 through the delay telescopic rod 45, so that the hook body 9 firstly rotates back and then the movable block 8 is rotated and limited.

In use, the release actuating mechanism 29 rotates to drive the connecting rod 13 to move downwards while the movable block 8 is opened under the lever effect, so that the hook body 9 drops; and meanwhile, the nut block 37 synchronously rotates along with the release actuating mechanism 29 and the lead screw shaft 38 jacks under the lever effect; the first rack 39 and the second rack 41 synchronously ascend, and the third rack 44 descends, so that the movable block 8 is guaranteed to be opened under the lever effect, and thus, the hook body 9 smoothly drops. When the hook body 9 needs to withdraw again, the direct-current motor 2 is controlled to drive the release actuating mechanism 29 to reversely rotate, and the lead screw shaft 38 descends to further drive the first rack 39 and the second rack 41 to synchronously descend; the second rack 41 drives the shaft gear 42 to reversely rotate through engaged effect, so that the hook body 9 is withdrawn; and meanwhile, under the action of the synchronous gear 43, the third rack 44 synchronously ascends; jacking of the starting plate 46 is delayed due to telescopic effect of the delay telescopic rod 45 until the hook body 9 is withdrawn to the initial position; the delay telescopic rod 45 starts to jacking the starting plate 46, so that the movable block 8 synchronously rotates to the initial position when the hook body 9 is withdrawn to the original position under lever effect.

The technical contents not described in detail in the present invention are all known technologies.

The invention claimed is:

1. An acoustic-electric remote control release hook used on water and underwater, comprising a first shell and a cylindrical framework, wherein:

a release hook assembly in which a direct-current motor, a controller, a receiver and a power supply are mounted is mounted on a lower portion of the first shell;

the power supply is respectively connected with a power supply end of the direct-current motor and a power supply end of the controller, a signal input end of the controller is connected with the receiver, a signal output end of the controller is connected with a driver of the direct-current motor, and a motor shaft of the direct-current motor extends downward to an outside of the first shell;

the release hook assembly comprises side plates, a hook body and a movable block, upper portions of the side plates are fixed with the first shell, one side of the upper portions is hinged with the movable block, and lower portions of the side plates are hinged with one end of the hook body;

an end part, close to a hinged point with the side plates, of the movable block is equipped with a clamping structure matched with a free end of the hook body, and a release actuating mechanism is arranged between another end of the movable block and the motor shaft;

the release actuating mechanism can control the movable block to be separated from the free end of the hook body;

the cylindrical framework is fixedly connected with the first shell in a detachable mode;

a first underwater transducer is fixedly arranged inside the cylindrical framework in the detachable mode;

the first underwater transducer is remotely matched with a second water transducer which extends to the underwater through a cable, and the second water transducer is connected with a control switch through a cable;

an acoustic command receiving module is arranged inside the first shell, and a power supply end of the acoustic command receiving module is connected with the power supply;

a signal input end of the acoustic command receiving module is connected with the first underwater transducer through a cable and a watertight connector assembly, and a signal output end of the acoustic command receiving module is connected with the driver of the direct-current motor;

the end part of the movable block is fixedly equipped with a connecting rod which is matched with the release actuating mechanism;

the release actuating mechanism comprises a fixator mounted at the lower end of the motor shaft; the fixator comprises two clamping teeth which are symmetrically arranged, and arc-shaped through slots are formed in upper portions of the two clamping teeth;

the arc-shaped through slots in the two clamping teeth are opposite and define a channel for accommodating the connecting rod; and when the motor shaft actuates, the connecting rod can be dropped from the clamping teeth or the connecting rod is fixed with the clamping teeth;

the two side plates are arranged in parallel, and a cavity is formed between the two side plates; and the hinged end of the movable block and the hook body is arranged in the cavity;

a bottom end of the release actuating mechanism is equipped with a nut block which can synchronously rotate along with the release actuating mechanism; the nut block is screwed with one end of a lead screw shaft, the other end of the lead screw shaft is equipped with one end of a first rack, and the first rack is fixedly equipped with a second rack;

a side portion of an adapting shaft between the side plates and the hook body is equipped with a shaft gear which is engaged with the second rack, and the shaft gear can drive the hook body to rotate; the side walls of the side plates are further equipped with a third rack in a sliding mode, and a synchronous gear is arranged and meshed between the third rack and the first rack; and when the first rack moves downwards, the third rack moves upwards under action of meshed transmission; and one side of the movable block is further equipped with a starting plate, and the top end of the third rack is equipped with a jacking structure which can jack the starting plate.

2. The acoustic-electric remote control release hook used on water and underwater according to claim 1, wherein a hoisting ring is mounted above the cylindrical framework.

3. The acoustic-electric remote control release hook used on water and underwater according to claim 2, wherein the other end of the first rack is fixedly equipped with a transmission connecting rod which is fixedly equipped with the second rack; and the second rack can synchronously move along with up-down reciprocating motion of the transmission connecting rod, the first rack and the lead screw shaft in sequence.

4. The acoustic-electric remote control release hook used on water and underwater according to claim 3, wherein the jacking structure is a delay telescopic rod;

the top end of the third rack is fixed with one end of the delay telescopic rod, and the other end of the delay telescopic rod is fixed with the starting plate.

5. The acoustic-electric remote control release hook used on water and underwater according to claim 1, wherein the direct-current motor is a direct-current reduction motor driven by 12V, 24V or 36V voltage.

* * * * *